US008602161B2

(12) United States Patent
Brickell et al.

(10) Patent No.: US 8,602,161 B2
(45) **Date of Patent: *Dec. 10, 2013**

(54) TOWER CLIMBING ASSIST DEVICE

(75) Inventors: Christopher Gavin Brickell, Renton, WA (US); John Jerome Haigh, Fircrest, WA (US)

(73) Assignee: Safeworks, LLC, Tukwila, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/424,657

(22) Filed: Mar. 20, 2012

(65) Prior Publication Data

US 2012/0175186 A1 Jul. 12, 2012

Related U.S. Application Data

(62) Division of application No. 12/324,114, filed on Nov. 26, 2008, now Pat. No. 8,141,681.

(60) Provisional application No. 61/043,058, filed on Apr. 7, 2008.

(51) Int. Cl.
*B66F 11/04* (2006.01)

(52) U.S. Cl.
USPC ..... 182/37; 182/18; 182/19

(58) Field of Classification Search
USPC ..... 182/18, 19, 6, 37
See application file for complete search history.

(56) References Cited

U.S. PATENT DOCUMENTS

| | | | |
|---|---|---|---|
| 684,562 | A | 10/1901 | Wilhelm |
| 4,458,781 | A | 7/1984 | Ellis et al. |
| 4,904,916 | A | 2/1990 | Gisske et al. |
| 4,979,588 | A | 12/1990 | Pike et al. |
| 4,997,064 | A | 3/1991 | Motte et al. |
| 5,390,104 | A | 2/1995 | Fulton |
| 5,671,824 | A | 9/1997 | Keegan et al. |
| 5,845,739 | A | 12/1998 | Ohtsuki |
| 5,927,440 | A | 7/1999 | Freeman |
| 6,161,639 | A | 12/2000 | Jones |
| 6,330,931 | B1 | 12/2001 | Baillargeon et al. |
| 6,390,952 | B1 | 5/2002 | Wilson |
| 6,854,562 | B2 | 2/2005 | Kwak |
| 7,198,134 | B2 | 4/2007 | LeMieux |
| 7,404,360 | B2 | 7/2008 | Cylvick |
| 7,798,288 | B2 | 9/2010 | Blasek |
| 8,141,681 | B2 | 3/2012 | Brickell et al. |
| 2004/0020719 | A1 | 2/2004 | Kwak |
| 2004/0045768 | A1 | 3/2004 | Puszkiewicz et al. |

(Continued)

FOREIGN PATENT DOCUMENTS

| | | |
|---|---|---|
| CN | 2193173 | 3/1995 |
| DE | 20216895 | 1/2003 |

(Continued)

*Primary Examiner* — Katherine Mitchell
*Assistant Examiner* — Johnnie A Shablack
(74) *Attorney, Agent, or Firm* — Woodcock Washburn LLP

(57) ABSTRACT

A climb assist system is disclosed that dynamically adjust the rate and level of assist of a climber as the climber needs may change over the period of traverse of the ladder. A sensor detects the state of a person, such as the load exerted by the climber on a ladder exerts on an assist rope, to provide an upward support force on the climber to compensate the climber's weight. Additionally, a sender is provided to transmit the load data to a receiver and a receiver to receive the data from the sender. A controller interprets the received data and thereafter provides control through a controlled motor and drive to provide energy to the assist rope.

11 Claims, 10 Drawing Sheets

(56) References Cited

U.S. PATENT DOCUMENTS

| | | | |
|---|---|---|---|
| 2004/0262078 | A1 | 12/2004 | Bailey |
| 2005/0098383 | A1 | 5/2005 | Halevy |
| 2006/0032704 | A1 | 2/2006 | Chandra |
| 2007/0004567 | A1 | 1/2007 | Shetty et al. |
| 2007/0056801 | A1 | 3/2007 | Iversen |
| 2007/0158137 | A1 | 7/2007 | Peterson |
| 2008/0185221 | A1 | 8/2008 | Postma |
| 2009/0173573 | A1 | 7/2009 | Teichert |
| 2009/0211846 | A1 | 8/2009 | Taylor |
| 2009/0288913 | A1 | 11/2009 | Nielsen |
| 2010/0130108 | A1 | 5/2010 | Mann |
| 2010/0163339 | A1 | 7/2010 | Han |
| 2010/0219016 | A1 | 9/2010 | Meillet |
| 2010/0231402 | A1 | 9/2010 | Flynt et al. |

FOREIGN PATENT DOCUMENTS

| | | |
|---|---|---|
| EP | 1 277 495 | 1/2003 |
| FR | 2440906 | 6/1980 |
| WO | WO 2005/088063 | 9/2005 |
| WO | WO 2006/111737 | 10/2006 |
| WO | WO 2009/126541 | 10/2009 |

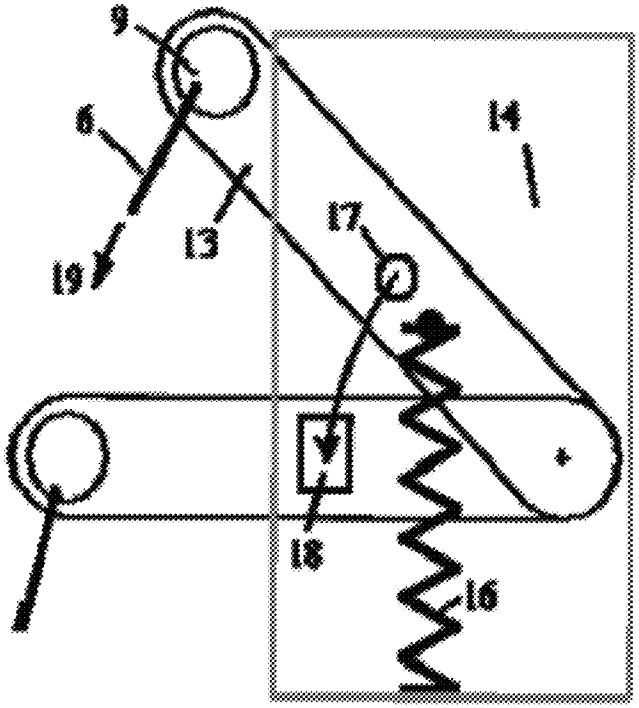
FIG. 2a Sensor
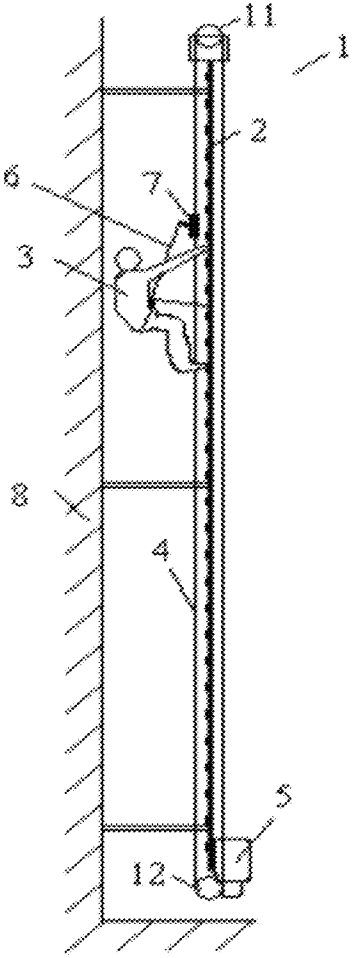
Fig 1

FIG. 2b Sensor
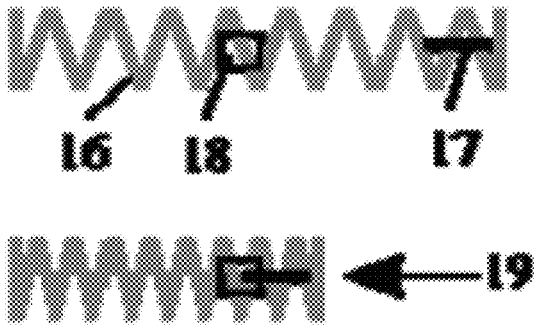
FIG. 2c Sensor
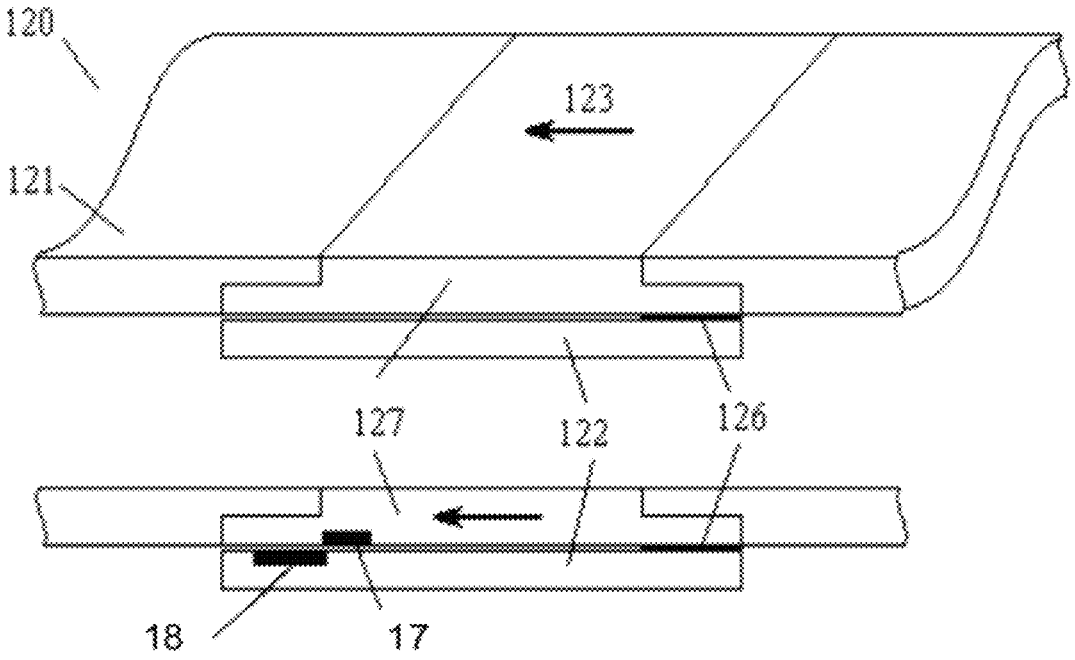

FIG. 2d Sensor
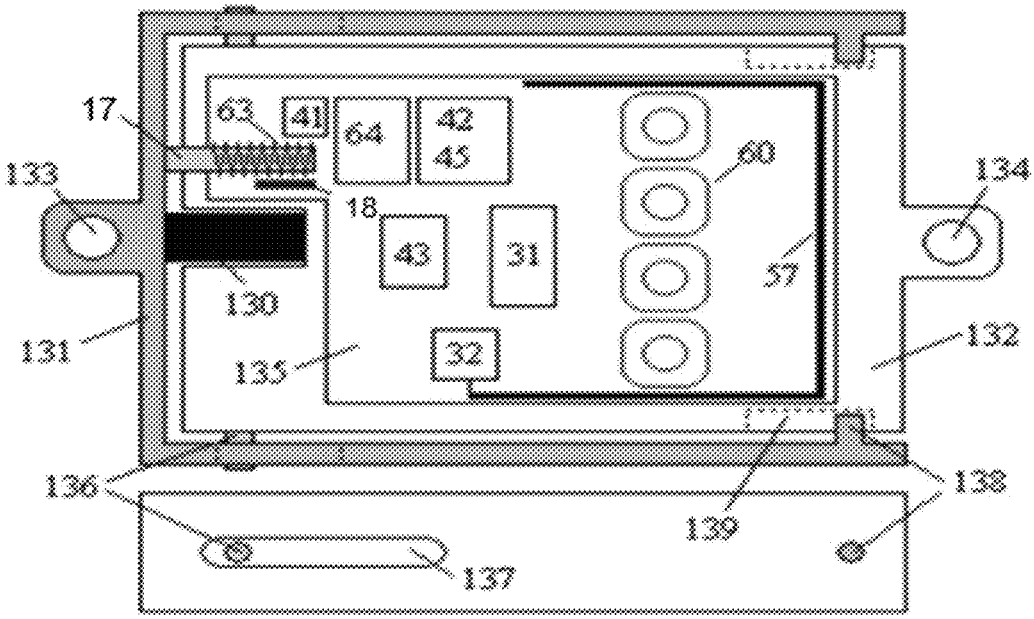
FIG. 2e Rope Grab-Sensor
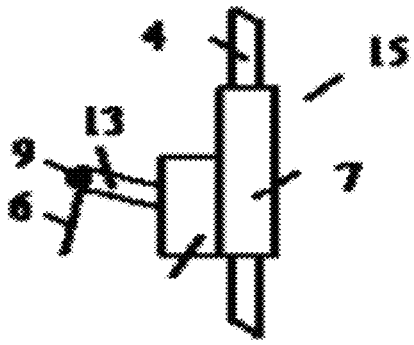

FIG. 5 Sender Schematic
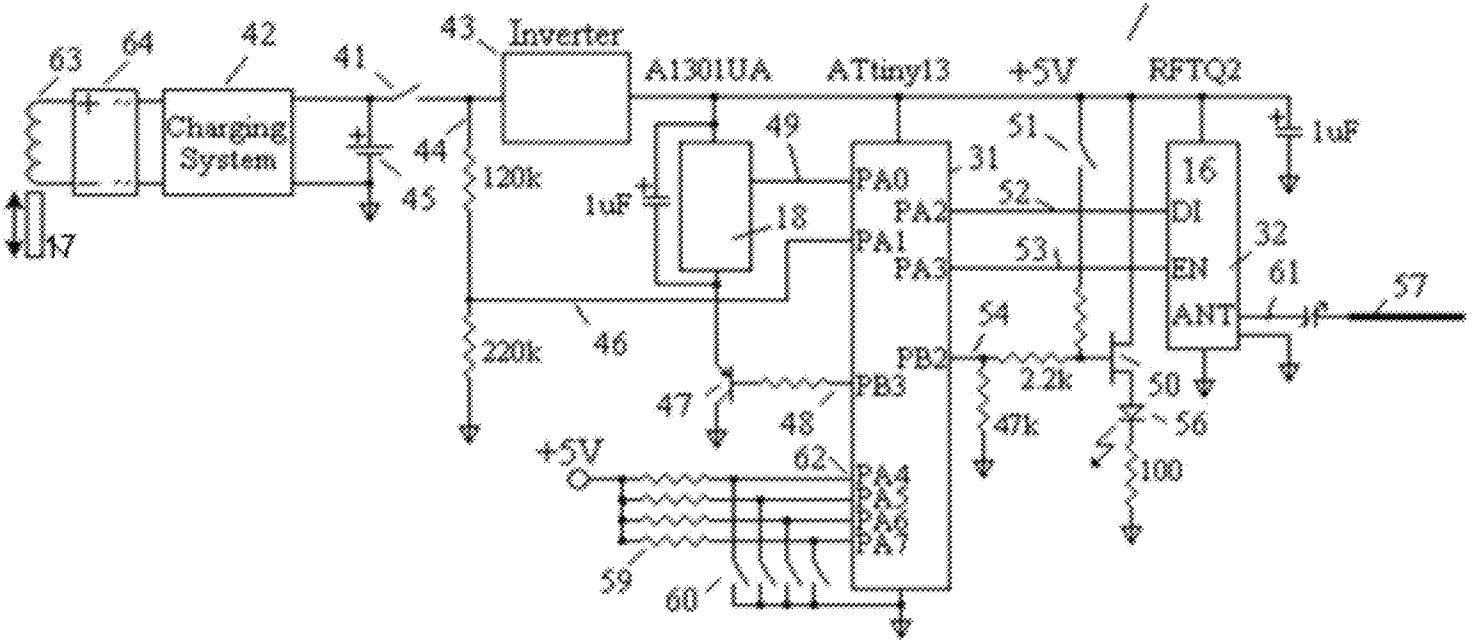

FIG. 6 Receiver Schematic
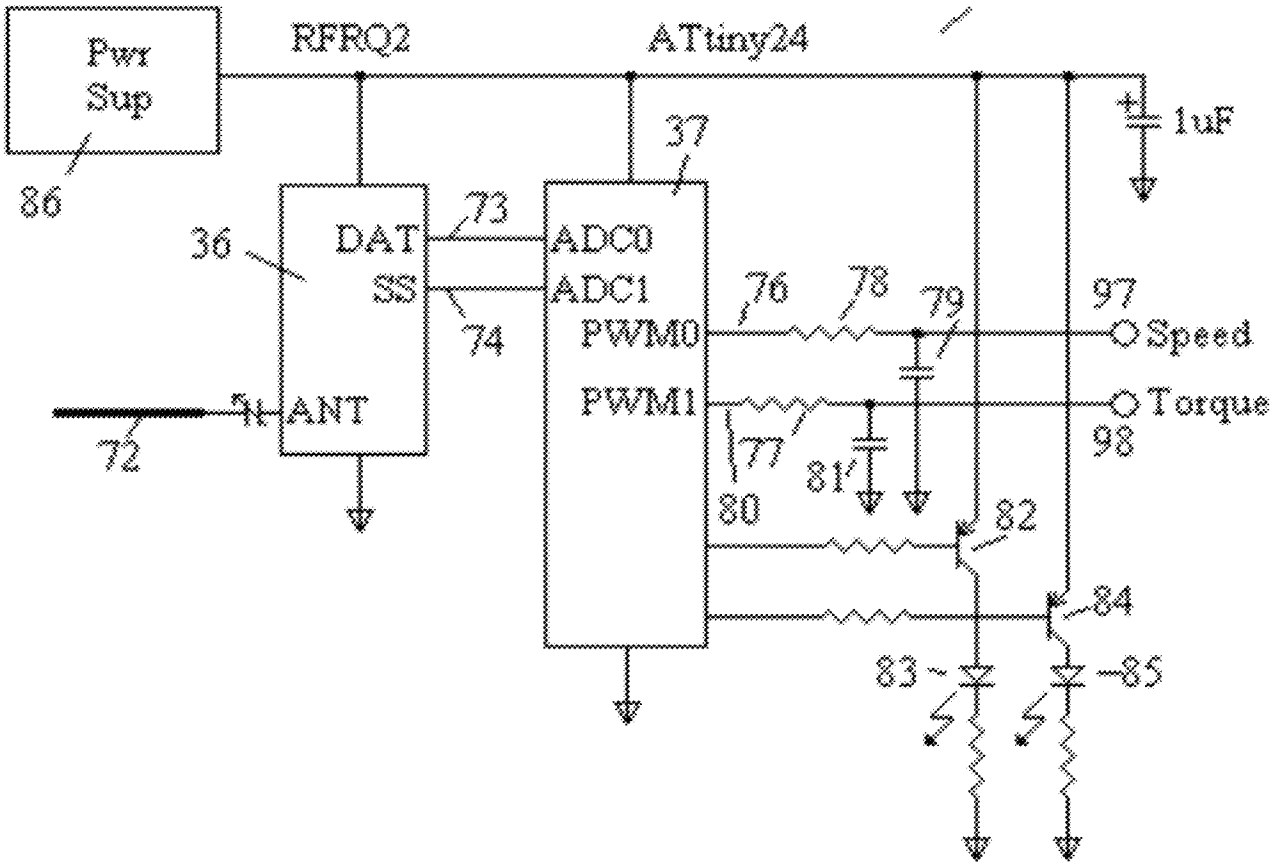

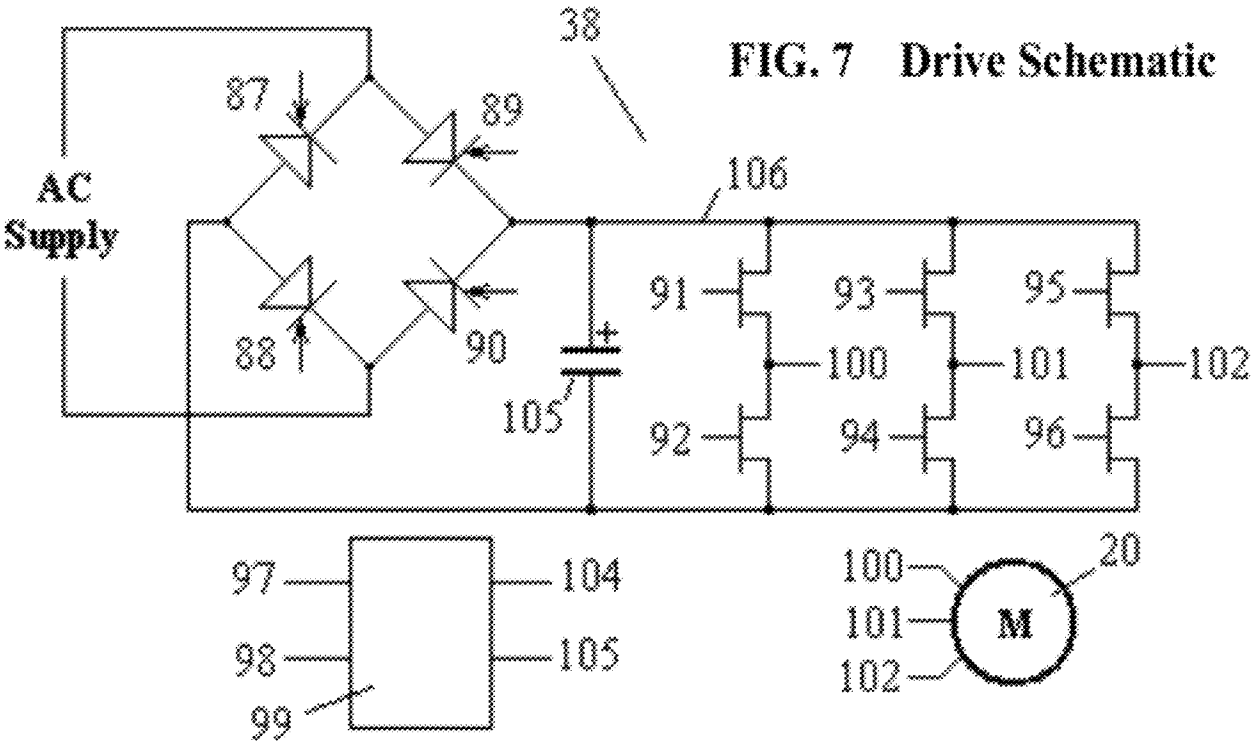
FIG. 7 Drive Schematic

FIG. 8 Sender Logic
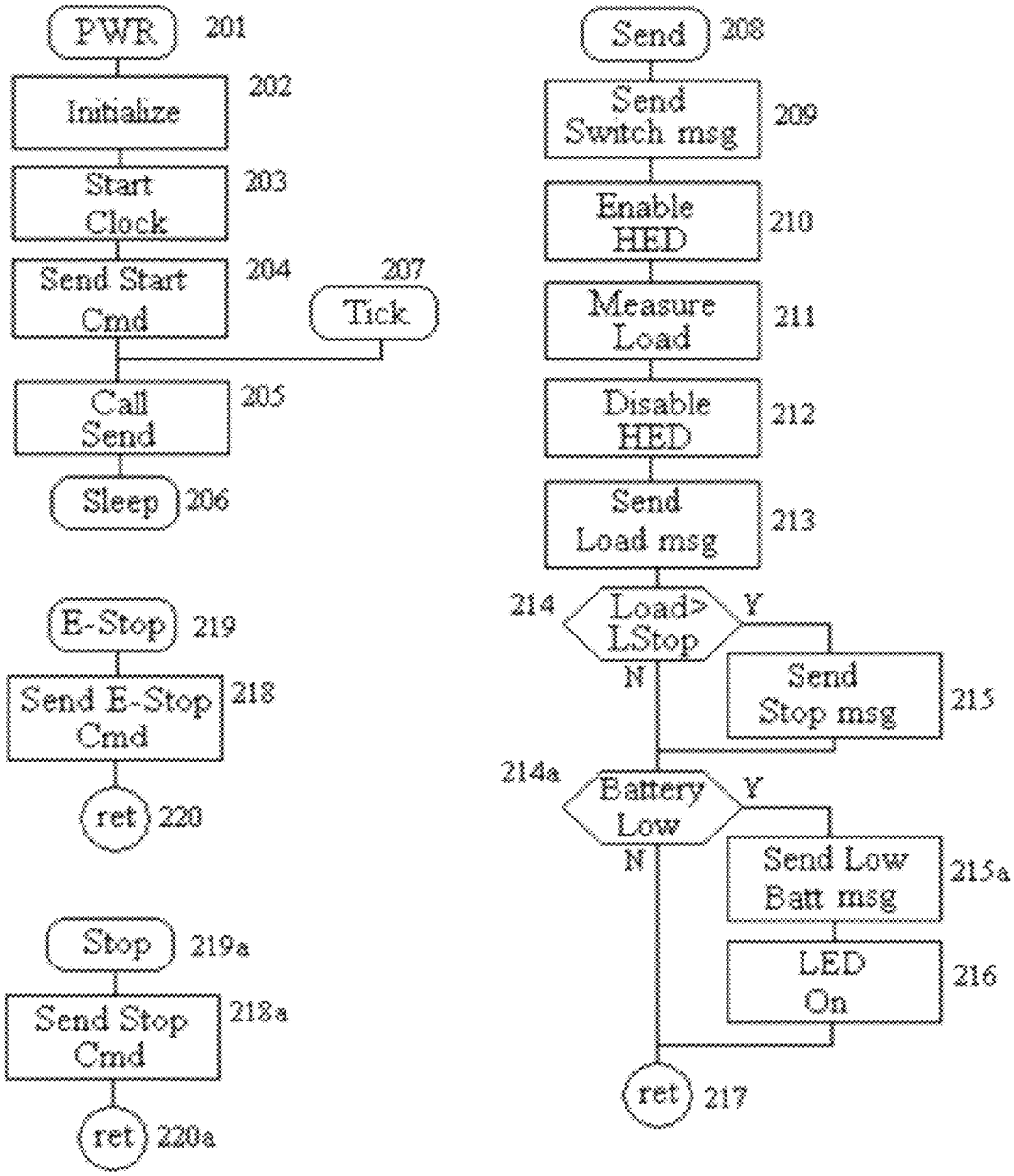

FIG. 9 Receiver Logic
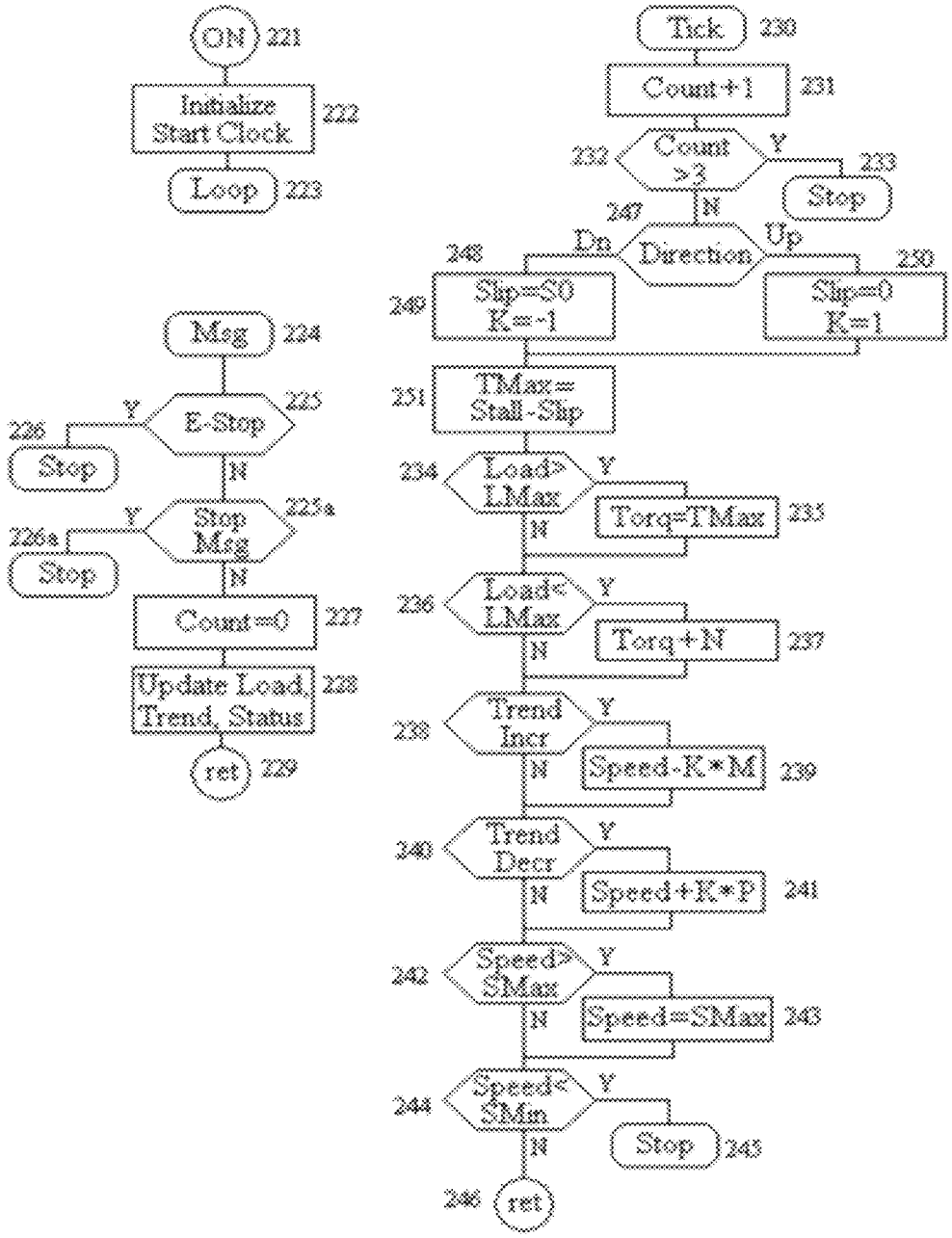

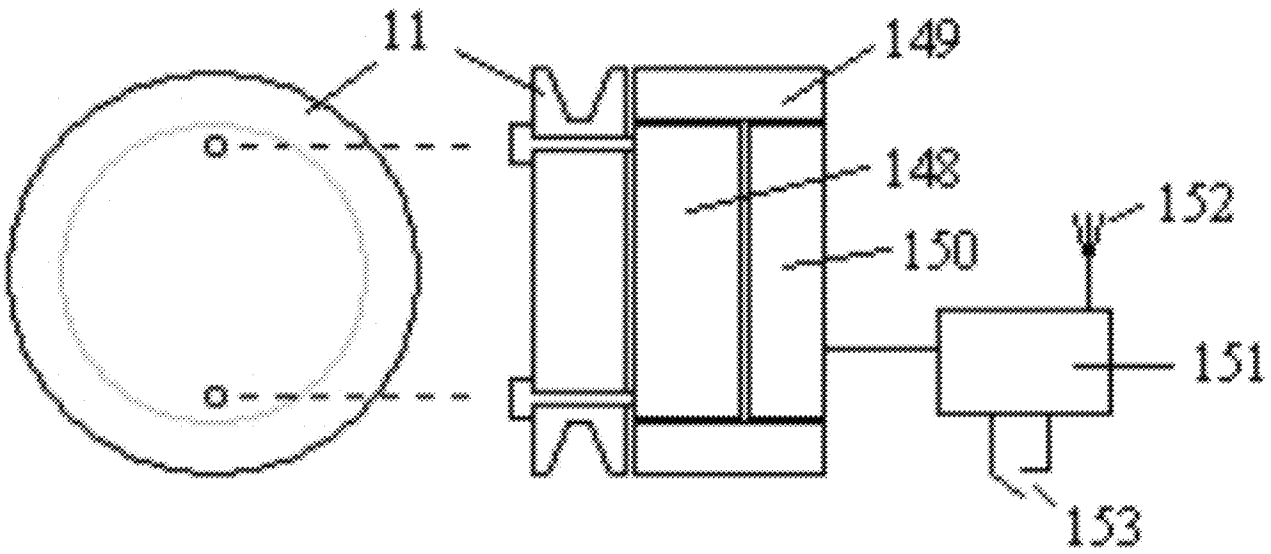
FIG. 10 Overspeed Governor

TOWER CLIMBING ASSIST DEVICE

CROSS-REFERENCE

This application is a divisional of U.S. patent application Ser. No. 12/324,114, filed Nov. 26, 2008, currently pending, which claims the benefit of U.S. Provisional Application No. 61/043,058, filed Apr. 7, 2008, the entirety of which is incorporated by reference herein.

TECHNICAL FIELD

This invention relates in general to a climber on a ladder, and in particular a means of providing support for a portion of the climber's weight during ascent and descent on the ladder.

BACKGROUND

Many ascent and descent devices are known, some of which us a counterweight such as U.S. Pat. Nos. 4,458,781, 4,997,064, 6,161,639, 6,684,562, 7,198,134, German Patent DE 20216895, and French Patent FR 2440906. These citations may be characterized as having at least one of several attributes selected among counterweight, motorized, drum winder, sheave traction device, single or dual sheaves, and endless loop. While counterweight devices can maintain a constant assist load, a climber often has to adjust such assist force by manually selecting a physical counterweight. These devices represent assist methods for ladder climbing such as may be found in cranes, oil derricks, buildings, etc.

Patent DE 20216895 discloses an endless loop motorized, assist device with removable motor and load limiting using a slipping clutch device. In general, this type of system is limited to maintaining a constant speed up to a specific load level.

A more recent publication in WO 2005088063 discloses a motorized, endless loop, system using a variable frequency drive to the traction sheave and includes motion detection with load limiting and control. While this system attempts to keep tension at a constant level, it does not provide dynamic adjustment of the rate of assist to a climber.

Additionally, control mechanisms of related ascent and descent devices typically control stop and run climbing actions by providing a sensor in a control unit near the bottom of the system. For example, Tractel discloses a system that can start or stop the device by causing the lower sheave to rotate and displace a switch to start the motor. Other system, such as Avanti, employs a control algorithm based on timed events.

SUMMARY

The invention is particularly useful for assisting a climber in climbing a ladder. For example, ladders inside of wind generating towers may have heights of 50 feet to 350 feet. Consequently, a climber may experience fatigue when climbing such a ladder. The assist system described herein provides assistance that reduces fatigue and enhances the safety of the climber when applied to such extensive climbs. Of course, the methods and systems disclosed herein may be applied to many other fields of use including rock climbing, building escape or rescue methods, or any other application requiring vertical or near vertical transport of a person.

An aspect of the invention is to provide dynamic adjustment of the rate and level of assist to the climber over the period of traverse of the ladder. The system allows implementation of differing control strategies ranging from constant speed (less desirable) to constant load (more desirable), or a hybrids of both strategies. In one aspect, the sensor is attached to the person to provide direct load sensing. In another aspect, the degree of assist may be prescribed, and be selectively dependent on attributes of the climber, namely level of fitness and the need for rest, body weight which could be low or high represented by reasonable range such as 100 lbs to 300 lbs, ability to climb fast or slowly, and how a climber may tire over a long climb with the resulting preferred change in the degree of climb assist. In general, the system provides the ability to select the degree of assist at any point in the climb. Moreover, the climber can communicate with the controller from anywhere during the climb.

Additionally, while indirect load sensing is provided in one aspect, it is preferable that the load imposed is directly sensed by the system and method described below.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the present disclosure is not limited to the specific methods and instrumentalities disclosed. In the drawings:

FIG. 1 shows a schematic side view of a ladder climb assist device according to the invention.

FIGS. 2*a*, 2*b*, 2*c*, 2*d*, 2*e* show a diagrammatic embodiment of the rope load sensor device according to the invention.

FIG. 5 shows a schematic diagram of a preferred embodiment of the sender according to the invention.

FIG. 6 shows a schematic diagram of a preferred embodiment of the receiver according to the invention.

FIG. 7 shows a reference schematic of a typical drive for motor control;

FIG. 8 is a flowchart illustrating a preferred embodiment of the sender algorithm according to the invention.

FIG. 9 is a flowchart illustrating a preferred embodiment of the receiver algorithm according to the invention.

FIG. 10 shows a diagrammatic embodiment of an overspeed governor according to the invention.

DETAILED DESCRIPTION OF ILLUSTRATIVE EMBODIMENTS

Figure 3B:
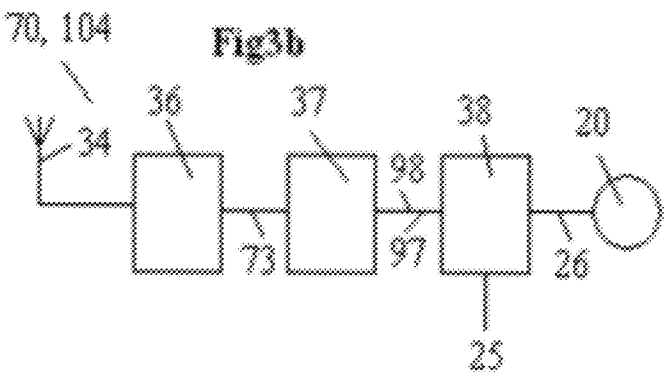
FIGS. 3*a* and 3*b* show a diagrammatic representation of the major components of the climb assist system according to the invention.

The embodiments disclosed herein are not limited in application to the details of construction and the arrangement of components set forth in the following description or illustrated in the drawings. The disclosure is capable of other embodiments and of being practiced or being carried out in various ways. Also, the phraseology and terminology used herein is for the purpose of description and should not be regarded as limiting In one embodiment, a sensor for detecting the state of a climber is provided. Specifically, a sensor for detecting a load a climber exerts on an assist rope is incorporated into the system. In order to control the amount of power needed to assist the climber. Additionally, the system also includes a sender to transmit the load data to a receiver, a transmission path, a receiver to receive the data from the sender, a supervisory controller to interpret the received data and a controlled motor and drive to provide energy to the assist rope. This disclosure specifies a one way wireless or open loop communication for system control, however full duplex communication is also possible where said receiver also transmits data to said sender for purposes which would include for example annunciation to the climber, bidirectional verification of integrity of the wireless link and message error correction. It is considered an adequate simplification to use open loop communications for this invention as described below. Of course sensors for detecting a change in a load of a person is only one example of determining the state of the climber. Alternative to, or in addition to, sensor for detecting a change in load, sensors for detecting any other change in the state of a person may be employed. For example, changes in eye movement, body temperature, heart rate, or other physical data are also a good indicator of a climber's state and physical attributes.

FIG. 1 shows a schematic climb assist system 1 side view of a climber 3 on a ladder 2 during ascent or descent on a tower. For example, a service personnel climbing a ladder during a maintenance routine of a wind generating tower. Said climber is attached by a rope grab 7 to an assist rope 4 which is preferably in the form of a continuous loop of material such as flexible wire or natural or synthetic rope with appropriate modifications or coatings to ensure efficacy in the application, extending between sheave 11 at the specified upper level of assist and sheave 12 at the specified lower level of assist. The preferred range of assist to the climber is in the range of 50 lb/sf and 120 lb/sf. Other higher or lower limits may equally be specified. Of course, the disclosed system is also useful for assisting a climber in ascending and descending in other structures such as signal tower, bridges, dams, and skyscrapers.

In this embodiment the preferred location of the drive system 5 is at the lower level and provides drive to the lower level sheave 12. Of course, alternative location of the drive system may also be used.

Attachment to assist rope 4 is by a lanyard 6 connected between a commercially available body harness worn by the climber and rope grab 7. In addition and as required by Occupational Safety and Health Administration (OSHA) regulations, said climber should be connected to an appropriate fall arrest device which is not further discussed in this disclosure.

Aspects of this invention relate to dynamic adjustment of the rate of assist manifest as the speed of assist rope 4, and level of assist of the climber manifest as the support of the load the climber exerts on assist rope 4. Climber needs may change over the period of traverse of the ladder as the climber needs to climb slower or faster than assist rope speed, and the weight of the climber. Consequently, the disclosed system takes account of climber fitness, weight and desired climb speed.

FIG. 2*e* shows a load sensor system 15 incorporated with rope grab 7. Lever 13 moves relative to structure 14 as load is applied to attachment point 9 by lanyard 6 attached to the climber's harness. Consequently, the signal representative of load is generated and communicated as further detailed below.

FIG. 2*a* shows a schematic view of a sensor system 15 incorporated into structure 14. When a load is applied to said lever 13, for example, at harness attach point 9, the spring 16 is compressed. Preferably, spring 16 is a wound wire compression spring but other types of spring systems may equally be applied for this purpose, including but not necessarily expansion or torsion types made of metal or other compressible materials and systems such rubber, elastic, hydraulic or pneumatic systems. As spring 16 compresses under increasing load, magnet 17 moves towards hall effect device (HED) 18 in the direction indicated by the arrow. The changing electrical signal from HED 18 may be measured as a representation of the applied load. Operation of HED 18 is well understood by those skilled in sensor design and methods and will not be further described. Of course, alternative to HEDs, other methods, such as employing a strain gauge as part of a load cell, may be implemented.

Alternative structures are contemplated to perform the stated functions, including but not exclusively selected from optical, alternative magnetic, strain, or resistive components. Also the neutral or zero external load position may be different from that disclosed in that the position of magnet 17 relative to said HED 18 may be towards or at the center, or disposed to the other side of HED 18 such that increasing load will cause magnet 17 to move away from HED 18. Then the relative direction of the electrical signal to movement of magnet 17 will change accordingly, but remains representative of the load applied.

FIG. 2*b* shows another possible arrangement for sensing load. Again, as spring 16 compresses as the applied load increases, magnet 17 attached to spring 16 is disposed to move relative to HED 18, and as before, will generate an electrical signal in HED 18 representative of the load. Similarly, the alternative sensing methods discussed above also apply to this configuration of sensing.

The sensors disclosed in FIGS. 2*a* and 2*b* may be configured for attachment to either rope grab 7 or to lanyard 6. Either way the sensors will respond directly to the load imposed between climber 3 and assist rope 4.

FIG. 2*c* shows yet another embodiment for a direct load sensing arrangement. In this embodiment the load reactive or stretchable material 127 is configured to be in series with lanyard 121 connected between the rope grab 7 and the body harness, and is directly responsive to the load imposed between climber 3 and assist rope 4. In the preferred embodiment, magnet 17 is embedded in stretchable material 127. One end of substrate 122 is fastened to lanyard 121 at 126 and carries HED 18. The end at 18 of substrate 122 is not constrained relative to lanyard 121. Positioning of HED 18 and magnet 17 is such that as load is applied, movement of magnet 17 relative to HED 18 generates an electrical signal as described above representative of the load. Of course, the positions of HED 18 and magnet 17 could be reversed, and additionally HED 18 and magnet 17 could both be placed on stretchable material 127.

To ensure that the electrical signal from HED 18 is not subject to erroneous interpretations as load changes, guiding systems may be incorporated in the structures to ensure that the relative position of magnet 17 to HED 18 is not subject to variation caused by orientation, vibration or other considerations. These are not specifically described as this is considered to be within the design capability of a skilled mechanical systems designer.

FIG. 2*d* shows yet another embodiment for a direct load sensing arrangement. In this embodiment the load reactive or stretchable material 130 is configured to attach between the outer shell 131 and the inner shell 132. Shells 131, 132 are constrained to move relative to each other in response to load being applied. In one application outer shell 131 may be attached to lanyard 6 at eye 133 and inner shell 132 attached to rope grab 7 at eye 134. Preferably, the attachment is by conventional means such as a carabiner. As shells 131, 132 displace relative to each other, stretchable material 130 provides a restoring force. Of course, an alternative arrangement where material 130 acts in compression may also be used.

Constraint of planarity and degree of available displacement between shells 131, 132 may be provided by pins 136, 138 moving within slots 137, 139 respectively.

Magnet 17 affixed to outer shell 131 alters its relative position to HED 18 affixed to inner shell 132 in response to load and as before provides a load responsive electrical signal. Additionally magnet 17 moves relative to coil 63 affixed to inner shell 132 and, consequently, is able to generate electrical current by well-known principles of Faraday's Law of Electromagnetic Induction. The electrical current may be applied to a rectifier 64 and charging circuit 42 to augment energy storage as disclosed below.

In the event the climber wants to terminate assist, either the load on sensor 30 may be increased so as to extend inner shell 132 to the maximum extent relative to outer shell 131 and activate a switch (not shown), for example by pin 138 operating the switch and immediately transmitting a stop message.

As a likely configuration in any of the above-described load sensing arrangements, the electronic components further described below may be disposed on a printed circuit board, for example 135. In addition, operable controls 60 may be included to allow direct selection of modes of assist. For example, said operable controls may be press buttons to select from a menu of speeds, load support, time responsiveness or other parameters which may be determined as desirable. Such selections then being communicated to said motor and drive to provide selected level of said assist.

Figure 3A:
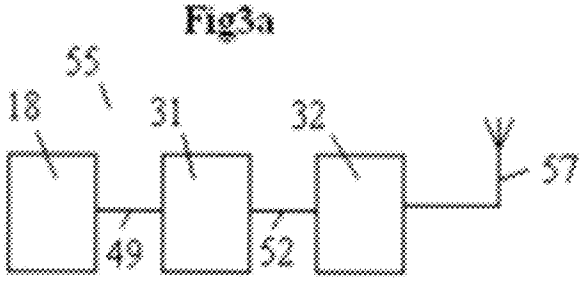

FIG. 3*a* and FIG. 3*b* show a diagrammatic representation of the major components for control of climb assist system 1. FIG. 3*a* shows a diagrammatic representation of a sender and FIG. 3*b* shows a diagrammatic representation of a receiver.

To directly sense the load imposed by climber 3 on assist rope 4, sensor 30 as described above incorporated with sender 55 generates an electrical signal representative of load which is applied to a microprocessor 31 on line 49. Microprocessor 31 sends a signal on line 52 to transmitter 32 and thence is transmitted from antenna 57 to antenna 34 at the supervisory system 22 of FIG. 4. The received signal is converted by receiver 36 in said supervisory system from antenna 34 and passed to microprocessor 37 for conversion to control actions based on specified received signals and control algorithms. Drive 38 converts power from main power supply line 25 to a form determined by microprocessor algorithms to determine activity of motor 20.

Figure 4:
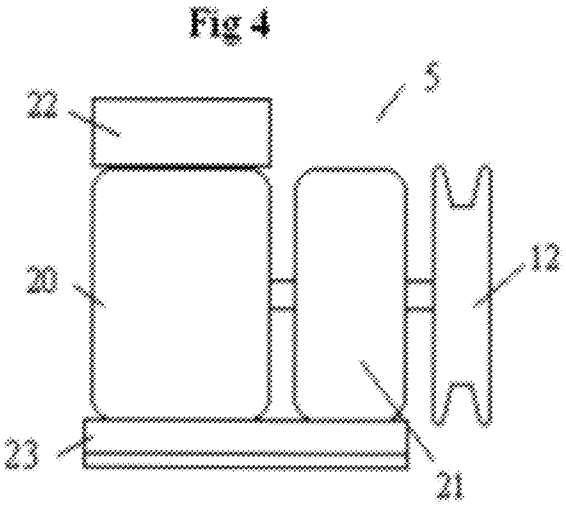
FIG. 4 shows a preferred schematic diagram of motorized drive system according to the invention.

FIG. 4 shows said motorized drive system 5 comprising a motor 20, drive 38 and supervisory system 22 and optional gearbox 21. Preferably motor 20 and gearbox 21 are mounted on a base 23. The motor type may be selected from ac or dc, synchronous, non-synchronous, synchronous, permanent magnet, brush or brushless, stepping and wound rotor and or stator types, as are well known. Motor 20 in this preferred embodiment is a synchronous ac type, however other types of motors will fulfill the requirements of this invention including single and multi-phase. The power delivered to motor 20 is from drive 38 which may be selected from commercially available types including variable frequency (VF), pulse width modulated (PWM), phase controlled, voltage controlled or current limited types. To convert between the rotational speed of motor 20 and lower level sheave 12, gearbox 21 may by interposed. Gearbox 21 may be selected from worm drive, planetary, harmonic, or other well-known types. These gearbox types each confer different attributes, and depending on the motor-drive selected, may be omitted, for example if the selected motor type is able to deliver the required torque without a gearbox and also provide for safe operation of the system under fault and emergency conditions. For convenience of description motor 20, gearbox 21 and sheave 12 are depicted as an in-line arrangement; however they may be positioned as required for mechanical convenience determined by respective structure.

While motor choice is not critical to the operation of the climb assist system, in one embodiment an induction motor using a gearbox for speed reduction is understood to be used, and optionally may include a brake to positively lock the system when power supply to the motor is terminated. Where a worm drive is implemented, as is well known from the high friction of reverse drive, the brake may be omitted. Additionally, it is understood that the drive system may also include a means of determining motor speed and direction of rotation as is well known to those skilled in motor and drive system design.

Drive 38 provides transformation from the external power supply to the power characteristic required by motor 20 to drive sheave 12. In this embodiment of the invention, the power supply to the system is 230 Vac and the power required by the motor is of variable frequency from zero to 120 Hz and voltage variable between zero and 230 Vac. Other external power supply values may be provided and other specified limits may additionally be imposed for motor control including current limit, overload sensing and overspeed sensing. This allows control of both motor speed and torque to provide the assist characteristics required.

Additionally, supervisory system 22 includes a signal receiver to receive signals from load sensor system exemplified by 30. In this preferred embodiment, the transmission method for the signal is wireless and is unidirectional from sensor 30 to drive 38. Of course, other implementations for transmission of the signal may be used such as wired, sound (ultrasonic), light (UV, visible or IR), induction (coupled via the assist rope if metallic), or other available methods. The nature of transmission of the signal will not be further considered in this invention and is considered well known to those skilled in the art. Also unidirectional transmission is specified for simplicity, but bidirectional including duplex transmission is also feasible and may offer the capability of communicating information from other sources, for example but not necessarily motor or drive conditions, communication link integrity and other advisory information.

FIG. 5 shows the schematic of a preferred embodiment of sender of FIG. 3*a*. The load sensor of FIG. 2, further described with reference to FIG. 5, comprises HED 18 responsive to magnet 17. The characteristics of HED 18 is such that it is responsive to the incident magnetic field with an output voltage approximating 2 mV per Gauss over a range of field strengths. The analog output voltage from HED 18 is applied to the analog to digital converter input of the microprocessor 31 on line 49.

A software algorithm of FIG. 8 executes on microprocessor 31 and transforms the analog voltage on line 49 to a digital pattern which is transferred to transmitter 32 on line 52 for transmission to a remote supervisory system that controls the climb assist response to sensed load. Alternatively, microprocessor 31 could be omitted and the signal on line 49 could be directly applied to a suitable transmitter, for transmission as an analog signal without digitization. The benefit of incorporating the microprocessor is to more reliably determine the characteristics of the transmitted signal, and to incorporate other information about the system.

To extend the available duration of operational time for the sensor, it is desirable to minimize the power consumption of the sensor. Several mechanisms may be employed in the sensor to achieve acceptably low average power consumption, for example to turn on HED 18 and transmitter 32 only when data is to be collected and transmitted, and to transmit data packets at a sufficiently high bit rate. When line 48 is set low to turn on PNP transistor 47, power is applied to HED 18. Also, microprocessor software may be configured to only turn on transmitter 32 when a signal is required to be transmitted and then turn it off upon completion of the transmission. To achieve this, transmitter 32 has an enable input which will turn it on to the higher power transmit state from the very low power consumption sleep state. When microprocessor 31 sets line 53 to the enable state, it turns on the transmitter. The signal for transmission is then applied on line 52. Upon completion of the transmission radiated via line 61 and antenna 57, line 53 may then be set to the not-enable state, then transmitter 32 enters a low power state and power consumption is reduced.

In addition, to further reduce power when no information is to be measured or transferred, microprocessor 31 may be set to various modes, one of which is where only restricted internal clock is operating. Consequently, the power consumption of the microprocessor may be reduced to a minimum value until the internal clock times out whereupon the software algorithm may be configured to: power HED 18 and transmitter 32, transmit the measured data, then resume the low power state with HED 18 and transmitter 32 in the off state and microprocessor 31 in the restricted clock state until the next clock timeout. The load sampling interval between measurement and transmission phases may be set from nominally zero, to any desired value. In this implementation of load sampling, the interval is between 0.1 and 10 seconds, with a preferred interval of 0.2 second. Note that the shorter the interval, the higher the average power consumption and the shorter the required time between energy storage device recharge cycles, or battery replacement. The load sampling interval may be varied dynamically throughout the period of climb to accommodate rapid setting of significant changes in the speed or torque required to provide effective climb assist, for example during initiation of climb assist.

Additional facilities may be provided in the sender for information display and operator signaling. Line 54 from microprocessor 31 may be set according the software algorithm to either input or output status. In this implementation line 54 is normally set as an input. If the operator closes switch 51, line 54 goes high and said microprocessor may be configured to respond to the change in signal level and wake up if in the restricted clock mode, otherwise it is awake. With said microprocessor configured to recognize transitions on line 54 as an interrupt, it will immediately respond to the change and through the software algorithm cause a signal to be transmitted, for example to effect an immediate stop of the assist motor providing an emergency stop function. When switch 51 is closed, LED 56 is illuminated via FET 50 to show the immediate stop state.

Also, if line 54 from the microprocessor is set high through the software algorithm, then LED 56 will be set high via FET 50. This may be used to signal whether the software algorithm is appropriately programmed to recognize specified conditions of interest to the operator, for example low battery or energy storage device voltage. Of course alternatives to, or in addition to, LED 56 may be implemented, for example a sounder device to attract the operator's attention. Signaling via LED 56 may be coded to represent different conditions, for example LED 56 may be pulsed at a rate or on to off ratio to distinguish conditions such as low energy storage device voltage, failure of the HED, excess load, etc. Alternatively multiple indicators may be included.

Also shown are additional inputs 62 from switches 60. These switches may be used to set various modes of operation, for example assist speed, load or to set time delays of rates of change in application of assist.

Note that alternative assignments of functions are possible with any suitable microprocessor. This embodiment demonstrates one of many arrangements that anyone skilled in microprocessor systems may conceive.

While sensor 30 implements unidirectional transmission, bi-directional communications are also possible where the sender is capable of receiving signals as well as sending signals. The reason for using a bi-directional system, for example, may be to quickly ensure integrity of communications or send alerts or information to the climber. However, this is not considered to be an advantage in this implementation of the assist system because of the facilities provided in the assist system, for example, for the supervisory system to turn off the assist system capability if signals are not received from the sensor within a specified time, for example, but not necessarily within 3 seconds of the last transmission from the sender. If the sender transmits a signal 5 times per second, then a 3 second wait period would provide an indication that the communications path had failed and the drive system could enter a safe state until communications resume. Also it is likely that where the sensor includes bidirectional communication, then average power drawn from the energy storage device may increase, potentially reducing the duration between recharge cycles to the detriment of usability, and may also increase the cost of the assist system.

In a preferred embodiment, the power supply comprises an energy storage device 45, for example a rechargeable battery and a voltage converting inverter 43 to provide the desired operating voltage for operation of the system from a range of voltages of said energy storage device.

The sender 55 is turned on when, for example, the load responsive magnet 17 moves into range of a switch 41. For example, a reed switch placed in proximity of magnet 17 connects the energy storage device 45 to inverter 43 to provide the required voltage, for example 5V, to the sender. Other means may be provided for powering the transmitter, and preferably the power is applied only when the assist system is required to operate. As another alternative, the switch could be a mechanical switch manually operated, or mechanically coupled to respond to attachment and movement of the sensor as previously disclosed.

With reference to FIG. 5, the sensor is preferably supplied by an integral energy storage device, for example a rechargeable battery. Optional charging systems 42 may be provided depending on the type of said energy storage means for example selected from types such as:

- Alkaline & Zinc-Carbon with 1.52V per cell (not rechargeable)
- Mercury with 1.35V per cell (not rechargeable)
- Silver Zinc with 1.86V per cell (not rechargeable)
- Nickel Metal Hydride with 1.2V per cell (electrically rechargeable)
- Nickel Cadmium with 1.2V per cell (electrically rechargeable)
- Lithium Ion with 3.6V per cell (electrically rechargeable)
- Supercapacitor (electrically rechargeable)
- Fuel cell (chemically rechargeable)

This is an example list and other types of energy storage means may be available. Each energy storage means has a specified discharge characteristic where the decrease in voltage output over time has a particular characteristic. Note that a single cell is depicted, however multiple cells may also be specified to bring the total voltage to the operating level required and thereby eliminate the need for said inverter.

Either a non-rechargeable energy storage device for example a zinc carbon cell may be used which would require periodic replacements, or where a rechargeable battery is used, the function of the charging system is to recharge the battery to ensure adequate energy for operation whenever needed. Many known possible charging systems are available, some of which may be selected from:

- inductive energy transfer where the sensor is stored in proximity to a coil carrying alternating current to induce energy into a power receiver coil in the sensor when not in use, or;
- direct connection from an energy source to the energy storage device, or;
- ambient energy scavenging using piezo-electric generation from ambient vibration, thermoelectric effects, photoelectric generators, stray electric fields, etc. to provide the energy input, or;
- as depicted in FIG. 2*d* using the Faraday's Law of Electromagnetic Induction, and exampled in FIG. 5 with reference to 17, 63, 64 and 42 where movement of magnet 17 relative to coil 63 generates charge, rectified by 64 and applied as a charging current to energy storage device 45 via charging system 42, as is obvious to those skilled in electronic systems.

The function of inverter 43 is to transform the battery voltage, for example 1.2V to the required operating voltage for the sensor components, for example 5V. A well-known method to transform the voltage is to use a boost switching capacitor regulator or boost switching regulator such as are manufactured by many semiconductor manufacturers, for example the National Semiconductor Corporation.

In the example of the sender described herein, the preferred voltage is 5V.

To provide information about the condition of energy storage device 45, the voltage at line 44 may be sampled and applied to the analog to digital converter input of the microprocessor 31 on line 46. By this means, the sensor may transmit additional information about power supply status to the supervisory system.

As a further alternative to the use of energy storage device 45, commercially available energy harvesting devices may be employed where a transmitter such as that available from http://www.adhocelectronics.net/download/EnOcean/PTM230_Datasheet.pdf may be used. In this case the energy harvested from the environment is that from an electrodynamic power generator resulting from movement, changed pressure or temperature, or other physical events.

FIG. 6 is a preferred embodiment of receiver 70. Power supply 86 supplies 5V to the components of the receiver. Receiver 36 receives signals from sender 55 on antenna 72 and converts the received signal to demodulated data on line 73, which enters microprocessor 37 for processing by software according to the preferred control algorithm. The received data is interpreted by the control algorithm which in turn generates signals significant of the preferred speed of the assist rope and preferred torque delivered by the motor 20.

In one embodiment, speed and torque signals may be developed according to a PWM method said that is executed on a microprocessor. In that case, the PWM signals on line 76 and 77 may be respectively converted to substantially steady signals on lines 97, 98 by low pass networks 78, 79 and 77, 81 respectively.

Other methods of generating speed and torque signals may also be employed, for example using a digital to analog converter to provide signals 97 and 98. Of course if a received signal was already in analog form, an appropriate scaling algorithm may be employed to provide signals 97 and 98.

With reference to FIG. 7 and by way of example of one several possible implementations to control motor 20, drive controller 99 would develop signals 104 and signals 105 from signals on lines 97 and 98 to control the voltage and frequency respectively of the supply to motor 20. For example, timing of signals 104 would be set to trigger the SCRs 87, 88, 89, 90 to develop the desired mean dc voltage at capacitor 105 on line 106. To operate the motor the power switch devices 91, 92, 93, 94, 95, 96 would be switched by signals 105 in a sequence to provide the correctly phased supply to said motor on lines 100, 101, 102. This schematic is diagrammatic only and other configurations are possible, for example, signals 104 and 105 may be multi-phased.

Of course, if the motor is of a different type such as a dc series motor, then the controller would be appropriate to the motor to provide the required speed and torque control. For example, as a considerable simplification, a single output such as 97 may be applied to a commercially available SCR drive to provide voltage control to a DC type motor thereby providing speed and torque control according to the desired algorithm for climber support.

When an initiating transmission from the sender is received, motor 20 will ramp up over a period such as 1 second to provide an initial torque and speed to provide a limited assist for example of 50 lbs with a corresponding climb rate determined by the climber.

In this embodiment of the invention, both climb assist load support and speed of the rope loop may be limited in the control algorithm. In addition, although it is not depicted in the figures, sheave 12 may be coupled to the system by a slipping clutch according to well-known principles which would prevent excess climb assist load, for example, greater than 120 lb/sf, from being applied to the rope loop. In the event of the load being applied that exceeds the rated value for the clutch, sheave rotational speed would differ from the input drive to the clutch and thereby limit delivery of assist.

Of course a maximum value of assist may also be set by selecting a motor with a specified maximum deliverable torque. Alternatively current limiting in the drive may be employed to limit applied assist force.

As one feasible method to terminate assist to the rope loop, for example when the climber wants to stop the system, the climber sags back against the assist direction for a specified minimum time, thereby exerting a load greater than a specified maximum load. When the control algorithm senses a load that exceeds the specified maximum load for a specified time, for example 3 seconds, then assist will be removed from the rope loop and braking will be provided to limit further rotation. Optionally, the climber operates a control on the sender to terminate assist.

FIG. 8 is a flowchart illustrating a preferred embodiment of the sender algorithm. The function of sender 55 is to transmit information to receiver 70 representative of activity of the climber and status of sender 55.

When the sender is activated by the climber, the sender is powered on at 201 by, for example, the application of a load causing switch 41 to close. Microprocessor 31 is then initialized at 202 and an internal clock is started at 203. The clock is configured to generate a clock tick at a specified interval, preferably but not necessarily 5 per second. Of course other intervals may be selected. At 204, a Start command is sent to the receiver to initiate assist, then at 205 the routine Send 208 is called which provides data to the receiver about the status of load and sender settings. Once the routine completes, the microprocessor enters a low powered Sleep condition at 206 where power consumption is minimized until the next clock tick occurs at 207. At every instance of a tick. the subroutine Send is called, after which Sleep mode is re-entered at 206.

When subroutine 208 is called, the status of any operator controls 51, 60 are sent at 209, for example, but not necessarily an indication of up or down direction climber desires to move. Alternative means of commanding desired direction may be employed such as a multiple tug on lanyard to cause sensor to interpret this as a down direction command, whereas a single tug would be interpreted as an up direction command.

HED is enabled at 210 via transistor 47, the signal representative of load exerted by the climber from HED is read at 211 by microprocessor and HED is disabled at 212 to conserve power. A message representing measured load is sent at 213.

At 214 the value of the measured load is assessed, and if it exceeds a specified value LStop, then a stop message is sent at 215 to the receiver to terminate assist drive. Such an event may be caused by as the climber deliberately sags back against assist rope to stop assist.

If battery condition is measured as low at 214*a*, a low battery warning message is sent at 215 and the LED 56 is turned on at 216 to warn the climber of low battery status. Of course said LED draws extra power, so it may be operated in a pulsed manner to minimize extra power consumption.

The described cycle repeats at every tick. At each cycle, additional power is drained from the energy storage device 45, and particularly as current consumption during each transmission is relatively high. While the foregoing description included multiple instances of transmission at 204, 209, 213 and 215, a compilation of each category of message into a single transmitted packet may provide a significant reduction in power requirement.

If an immediate stop is required and further operation of the assist system is to be prevented, a switch correspondingly given the function Stop may be configured to cause an interrupt at 219*a* and immediate transmission of the Stop command 218*a* is made. To improved assurance of the command being enacted, sender may optionally transmit Stop command multiple times.

To extend availability of power it is advantageous to provide a means of augmenting available energy such as previously described.

FIG. 9 is a flowchart illustrating a preferred embodiment of the receiver algorithm. The function of the receiver 70 is to receive messages and commands from sender 55 and control motor 20 accordingly to provide the desired level of assist to the climber.

When power is applied to receiver at 221, microprocessor 37 is initialized at 222 and a clock is started. Clock is configured to generate a clock tick at a specified interval, preferably but not necessarily every one second. Of course other intervals may be selected. The program then waits for an event to occur in a loop at 223.

During initialization, key parameters may be set, such as the starting speed and/or torque for assist. Such minimum values are set such that the climber is not subject to sudden jerks or excessive force or an assist speed which could cause distress and risk of injury to the climber.

Preferably, but not necessarily, interrupts are used to initiate responses to tick events, and to receipt of a message from said sender. Other events such as operator control actions at the drive system or from controls where provided may also cause actions. In an interrupt driven system and as described herein, an interrupt will act to cause a specified service routine to enact and complete. Thereafter, operation returns to the function operating at the moment of the interrupt. In described embodiment, it is most likely that interrupts will occur while the receiver is executing the wait loop 223.

On receipt of a message, the segment at 224 is entered from the loop. If the message contains a stop command, the drive system is stopped and assist is removed.

Although the distinction between an immediate stop message at and a stop command message, it may be preferable that an immediate stop will disable all further operation until power to the receiver is recycled off-on, or some other intervention action is made, whereas a stop command will stop the assist drive with further enablement being possible by normal command from sender.

Once a message is received at 224 that is not of the stop class, the value Count is reset to zero to prevent premature cessation of assist, and the records of data contained in the message such as load, load trend computed from a history of load samples and switch settings is updated at 228, and the routine is exited.

On generation of tick, the routine at 230 is initiated and a counter is incremented at 231. The purpose of the counter is to provide a timer to time out and terminate assist if no further messages are received from said sender. At 232 the count is checked and if it exceeds a limit value for example but not necessarily 3, then the drive system is stopped and assist is removed. A variety of subsequent control actions may be defined, including re-enabling assist by re-starting said drive system based on commands from the climber. Alternatively the power to the drive system may be recycled to re-initialize the system for normal resumption of operation.

If count has not reached the limit value then parameters K and Slip are set at 248 and 250 based on the sensed direction of assist at 247 required by the climber, and the value TMax is set at 249. Specifically, K determines the direction of modification of torque and speed for assist and Slip sets the degree to which the motor drive may be allowed to run forwards or backwards according to the climber direction being up or down. When loaded to a specified amount, the torque limit of the motor, TMax, will determine motor slip which is defined as the deviation between the no-load and loaded speed. Consequently TMax is set at 251 or another value in the range such as 0 to 255

At 234 the value of the measured load is compared with a specified value stated as LMax, for example but not necessarily 120 lbs, and if greater than LMax then the drive system torque TMax is set to the maximum value at 235.

At 236 the value of the measured load is again compared with said specified value stated as LMax, and if less than LMax then the drive system torque is changed by a factor K*N at 237. Factor N may be chosen as for example but not necessarily 10% of the maximum specified value of LMax. Consequently said assist torque may be progressively changed in steps towards the desired maximum value LMax without feeling jerky to the climber. Note that K is +1 or −1 accordingly as the direction is up or down.

Of course if the climber sags back against the assist in the up direction and load exceeds said value LStop then assist will be terminated as previously described. In the down direction assist will stop after a delay once load on the sensor is removed or communications ceases, and additionally once said rope grab is unloaded it may be designed to no longer have frictional attachment to said assist rope as is a characteristic of commercially available rope grabs, so will cease support to the climber.

At 238 the value of the trend of the load is assessed, and if it is increasing for the up direction, it implies that the climber may be tired and unable to keep up with the level of assist being provided, consequently the speed of assist may be decreased by a factor M (K=1) at 239. In the down direction an increase in load trend implies that the climber may want to descend faster, so speed is increased by the factor M (K=−1).

Factor M may be chosen as for example but not necessarily 10% of the maximum specified value of speed. Consequently said assist speed may be progressively decremented towards a desired minimum value without feeling jerky to the climber. Note that the minimum value may also include zero speed and that K is +1 or −1, accordingly, as the direction is up or down.

At 240 the value of the trend of the load is assessed, and if is decreasing for the up direction, it implies that the climber may be moving faster than assist is providing support. Consequently the speed of assist may be increased by a factor P at 241. In the down direction an increase in load implies that the climber wants to descend faster, so speed is decreased by the factor M (K=−1) to allow higher slip.

Factor P may be chosen as for example but not necessarily 10% of the maximum specified value of speed. Consequently the assist speed may be progressively incremented towards a desired maximum value SMax without feeling "jerky" to the climber.

At 242 the value of assist speed is assessed and if it exceeds a specified maximum value SMax then speed is set to SMax at 243.

At 244 the value of the speed is assessed and if less than a specified minimum value SMin, for example but not necessarily 5 ft/min, then assist will be terminated as previously described.

Following completion of Tick processing the receiver returns at 246 to continue the wait loop at 223 until a next event occurs.

In the above, it is understood that the maximum value of torque TMax is for example but not necessarily such as to deliver 1201*b*/sf to the climber. Also the maximum speed SMax is such that the speed of the assist rope 4 is for example but not necessarily 100 ft/min.

Additionally it is understood that there may be several classes of stop condition defined where differing actions result such as:

- an immediate condition where the drive system is completely disabled from further assist, for example at 219*a*; and,
- a normal stop condition, for example where the climber sags back against said assist rope. In this condition the system may be restarted upon climber command, for example at 214; and,
- where the assist speed is less than a specified minimum value, for example at 244. In this condition the system may be restarted upon climber command.

A further refinement to the algorithm in microprocessor 37 for control of assist delivered to the climber, is to use the well-known relationship between power (P), torque (T) and rotational speed (R) for a motor: P=kTR where k is a constant. In the above description of control using torque and speed where speed of the motor has a direct relationship to assist rope speed, then where one parameter is adjusted to suit a climber's need, then the other parameter would also be set to keep the equation P=kTR balanced. Of course other relationships between load and delivered power may be specified, preferably to maximize the climber's perception of value of delivered assist.

For example if Power P was a parameter selectable by the climber (possibly as a function of climber weight) as speed (R) was varied, then torque T would be adjusted using T=P/(kR). Similarly as torque varies, then speed R is adjusted using R=P/(kT).

Also it may be desired to provide further simplification of the system by varying only one parameter such as speed or torque, keeping the other parameter constant, however it is expected that a more satisfactory assist system would be experienced by the climber by keeping the selected power level constant. Such control may be exemplified where a DC motor is used, control being applied from applied voltage as previously disclosed.

Further, as a climber's load, as sensed the sensor, is not constant as the climber moves from ladder rung to rung, additional signal processing may be required to compensate for these climber induced cyclic variations in load and use filtered values of the measured signal representing load. In doing so, it may be expected that using a sampling rate, as preferred above, of one second may not be adequate. Correspondingly, the system may be set to a different sampling rate, optionally dynamically selected by further signal processing to provide an optimal representation of the climber's load.

As a further refinement in operation, it may be advantageous to include time delays to prevent undesirable changes in assist, for example when a small change is sensed in load or load rate, then a longer time delay, for example but not necessarily 3 seconds, may be imposed before changing assist, whereas if a large change occurs, then a shorter delay, for example but not necessarily 1 second, in changing assist may be utilized. Other time delays may be applied to starting and stopping assist according to the status of the system, for example an immediate stop should be immediate, whereas a normal stop may take longer, for example by ramping down the speed to zero, for example but not necessarily 1 second. Similarly when assist is started it may be desirable to ramp to the desired speed to prevent a jerk start, similarly for stop conditions. Note that soft-start and soft-stop are well known for motor control.

Of course, it is also possible to provide any desired level of processing as an algorithm operating in the sender microprocessor 31, including managing the relationship between power, torque and speed for transmission to the receiver for motor control; however to minimize power consumed by the sender, it is reasonable to expect that minimizing said sender processing requirements will reduce power consumption.

FIG. 10 shows a diagrammatic embodiment of an overspeed governor according to the invention. To prevent an overspeed condition causing a hazard to the climber in the event of a fault causing assist speed to increase beyond a safe value, an overspeed governor may be disposed in relation to either of the sheaves to terminate or limit assist, or as a function of a sheave in any position in the system.

For example FIG. 10 shows the top sheave 11 associated with a proportional governor where above a threshold speed of rotation of the sheave such as a climb speed of 100 ft/min, clutch 148 engages a brake 149 to progressively load or stall the drive system and limit the available drive from said motor. Where the brake acts to progressively load the drive system, an ultimate maximum speed may be set, for example but not necessarily 120 ft/min.

Further drive may be inhibited until the assist system is reset, for example, by running the sheave in the opposite direction momentarily.

As a further facility, said governor may include a power generator 150 to power communication from an associated sender 151 via antenna 152 to said receiver elsewhere in the event that an overspeed or any other fault condition is detected. It may also include a switch 153 so that a rescue mode can be initiated from the top location to avoid the need to descend first to set the desired mode. In a rescue mode it may be useful to include a facility where unpowered descent at a controlled speed relatively independent of load is provided. Using a motor in regenerative mode will provide such capability, for example as disclosed by hoists systems manufactured and sold by Power Climber, a subsidiary of SafeWorks, LLC.

As a yet further embodiment of a system for control of an assist system based on sensing of load of a climber to control power delivered to assist the climber, load could be sensed at either sheave with an appropriate load measuring apparatus. However this is considered as obvious and does not convey the advantages of the direct sensing method as described in this disclosure so has not been considered further.

It is understood that the term circuitry used through the disclosure can include specialized hardware components. In the same or other embodiments circuitry can include microprocessors configured to perform function(s) by firmware or switches. In the same or other example embodiments circuitry can include one or more general purpose processing units and/or multi-core processing units, etc., that can be configured when software instructions that embody logic operable to perform function(s) are loaded into memory, e.g., RAM and/or virtual memory. In example embodiments where circuitry includes a combination of hardware and software, an implementer may write source code embodying logic and the source code can be compiled into machine readable code that can be processed by the general purpose processing unit(s). Additionally, computer executable instructions embodying aspects of the invention may be stored in ROM EEPROM, hard disk (not shown), RAM, removable magnetic disk, optical disk, and/or a cache of processing unit. A number of program modules may be stored on the hard disk, magnetic disk, optical disk, ROM, EEPROM or RAM, including an operating system, one or more application programs, other program modules and program data.

The foregoing description has set forth various embodiments of the apparatus and methods via the use of diagrams and examples. While the present disclosure has been described in connection with the preferred embodiments of the various figures, it is to be understood that other similar embodiments may be used or modifications and additions may be made to the described embodiment for performing the same function of the present disclosure without deviating there from. Furthermore, it should be emphasized that a variety of applications, including rock climbing, building escape or rescue methods, or any other application requiring vertical or near vertical transport of a person are herein contemplated. Therefore, the present disclosure should not be limited to any single embodiment, but rather construed in breadth and scope in accordance with the appended claims. Additional features of this disclosure are set forth in the following claims.

What is claimed:

1. A system for assisting a substantially vertical ascent or descent of a load, comprising:

an apparatus coupled to a rigging movable in a vertical direction, said apparatus adapted to translate rigging movement into ascent or descent assistance of a load coupled to the rigging;

a sensor operable to measure an amount of force exerted by the load coupled to the rigging; and a control mechanism coupled to a power source and communicatively coupled to the sensor, the control mechanism operative to control power delivery from said power source to the rigging based on said measured amount of force of the load coupled to the rigging, wherein said power delivery is continuously provided and said sensor is operative to provide continuous feedback to said control mechanism based at least in part on said measured amount of force so that said power delivery is adjusted and support of the load coupled to the rigging is continuously maintained at a constant value, the constant value being selectable and the support provided continuously during the vertical ascent or descent of the load.

2. The system according to claim 1, further comprising a force sensing device configured to generate a signal to the control mechanism that is representative of said measured amount of force exerted by the load coupled to the rigging.

3. The system according to claim 1, further comprising an overspeed governor to prevent an overspeed condition.

4. The system according to claim 1, wherein the system is configured to operate in an unpowered descent mode that enables controlled movement of the rigging independent of the load coupled to the rigging.

5. The system according to claim 1, wherein the control mechanism comprises:

a processor; and a computing memory communicatively coupled to the processor, the computing memory having stored therein computer executable instructions that, when executed, cause a change in said power delivery as a function of changes in the load coupled to the rigging.

6. The system according to claim 5, wherein the change in power is also a function of the direction of the rigging.

7. A method for assisting a substantially vertical ascent or descent of a load, comprising:

using a sensor to measure an amount of force exerted by a load coupled to a rigging; and controlling power from a power source to the rigging based on said measured amount of force detected of the load coupled to the rigging, said power delivery being continuously provided and the sensor being operative to provide continuous feedback to said control mechanism based at least in part on said measure amount of force so that said power delivery is adjusted and support of the load coupled to the rigging is continuously maintained at a constant value, the constant value being selectable and the support provided continuously during the vertical ascent or descent of the load.

8. The method according to claim 7, wherein the sensor is coupled to an apparatus coupled to a rigging movable in a vertical direction, said apparatus adapted to translate rigging movement into ascent or descent assistance of the load coupled to the rigging.

9. The method according to claim 7, further comprising positioning a load reactive material between an outer shell and an inner shell, the outer shell and the inner shell being constrained to move relative to each other in response to forces exerted by the load coupled to the rigging.

10. The method according to claim 7, further comprising changing the power delivery as a function of a trend of the load coupled to the rigging.

11. The method according to claim 7, further comprising preventing an overspeed condition with an overspeed governor.

* * * * *